US005435899A

United States Patent [19]

Gimenez et al.

[11] Patent Number: 5,435,899

[45] Date of Patent: Jul. 25, 1995

[54] METHOD, DEVICE AND APPARATUS FOR THE SURFACE TREATMENT OF METAL CAN BODIES, IN PARTICULAR OF AL OR ALLOYS THEREOF

[75] Inventors: Philippe Gimenez, Le Mans; Gabriel Colombier, Saint Egreve; Dominique Petit, Pommiers la Placette; Claude Encrenaz, Voiron; Armand Golay, Moirans, all of France

[73] Assignee: Pechiney Recherche, Courbevoie, France

[21] Appl. No.: 142,963

[22] Filed: Oct. 29, 1993

[30] Foreign Application Priority Data

Nov. 3, 1992 [FR] France ..... 92 13437

[51] Int. Cl.[6] ..... C25D 17/00

[52] U.S. Cl. ..... 204/297 R; 204/297 W; 204/300 EC

[58] Field of Search ..... 204/300 EC, 300 R, 297 W, 204/297 R

[56] References Cited

U.S. PATENT DOCUMENTS

| | | | |
|---|---|---|---|
| 3,922,213 | 11/1975 | Smith et al. | 204/180.2 |
| 3,972,798 | 8/1976 | Palisin | 204/297 R |
| 4,094,760 | 6/1978 | Smith et al. | 204/300 EC |
| 4,246,088 | 1/1981 | Murphy et al. | 204/300 EC |
| 4,400,251 | 8/1983 | Heffner et al. | 204/300 EC |
| 4,812,211 | 3/1989 | Sakai | 204/300 EC |

FOREIGN PATENT DOCUMENTS 1077212 7/1967 United Kingdom .

*Primary Examiner*—John Niebling
*Assistant Examiner*—Kishor Mayekar
*Attorney, Agent, or Firm*—Dennison, Meserole, Pollack & Scheiner

[57] ABSTRACT

An apparatus for cleaning, rinsing and coating a metal can body comprising a tank for containing a liquid, an electrically conductive nozzle maintained in a substantially vertical direction and means for supporting a can body inverted over the nozzle. An electrical contact is disposed in an upper portion of the tank directly above the nozzle and the can body is free to move upwardly between the nozzle and the electrical contact under the force of liquid flowing through the nozzle.

13 Claims, 4 Drawing Sheets

METHOD, DEVICE AND APPARATUS FOR THE SURFACE TREATMENT OF METAL CAN BODIES, IN PARTICULAR OF AL OR ALLOYS THEREOF

BACKGROUND OF THE INVENTION

The invention concerns a method, a device and an apparatus for the surface treatment such as a cleaning operation and/or a covering operation for metal can bodies, preferably of Al or alloys thereof, more particularly can bodies which are produced by drawing, drawing and ironing or impact extrusion.

Before final filling such cans are generally prepared on their internal and/or external surfaces by means of cleaning treatments for removing the various pollutants resulting from the preceeding shaping operations (for example the residues of lubricants), and coating operations, generally using an organic material, in order to withstand subsequent physical or chemical attacks, both on the part of the content and the external environment.

A particular feature of the mode of manufacture of such cans is that they are formed at a high rate, of the order of 2000 cans per minute, which means that the cleaning and coating operations must be fast in order not to constitute a bottle-neck in their manufacture, whether the process is continuous (can-by-can) or discontinuous (in batches of cans).

The solution which is generally adopted in the prior art is treatment of each can individually and successively at a plurality of working stations, each being of very short duration, typically 1 second, and therefore involves an automatic system for fast transportation from one station to another, of the carousel type (see for example U.S. Pat. No. 3,969,136 or U.S. Pat. No. 4,883,578). In addition, as regards the organic coating which is generally deposited by electrophoresis, with the can constituting one of the electrodes, the counter-electrode or counter-electrodes must be disposed in the immediate vicinity of the surface of the can to be coated, which requires a specific device in relation to the size of can in question and thus involves multiplying the tools required, see for example GB-A-2 085 474 or U.S. Pat. No. 4,400,251.

SUMMARY OF THE INVENTION

The problem to be solved is therefore that of finding a method, a device and an apparatus for cleaning and coating metal cans, making it possible to treat a plurality of can geometries either successively or simultaneously, thereby avoiding the disadvantages or restrictions referred to above.

The device according to the invention comprises at least the following elements:

a nozzle of electrically conductive material such as graphite or a stainless steel, which is apertured with an axial duct, in a substantially vertical direction, and over which a can body to be treated can be disposed upside down; that nozzle can be electrically connected to a pole of a current source (DC or AC) and is supplied with the treatment fluid;

guide means permitting easy displacement of the can body in a substantially vertical direction; and an electrode forming an electrical contact, which is disposed above the bottom of the can body and which can be electrically connected to the other pole of the current source.

It may also comprise auxiliary electrodes which are internal or external to the can body and which can be electrically connected to one of the poles of the current source.

The device according to the invention can be used both in an apparatus for batchwise treatment of cans and in an apparatus for continuous treatment at successive stations of the carousel type; in addition it does not require narrowing of the neck and/or the formation of the flange portion, prior to treatment.

Therefore, in an installation for surface treatment of electrolytic nature (cleaning) or electrophoretic nature (coating), the method according to the invention comprises:

a) placing each can body upside down, in vertical alignment with a nozzle for the injection of fluid (electrolyte or electrophoretic suspension) in such a way that each can bottom, upon injection of the fluid, comes into contact with an electrode forming an electrical contact by a vertical displacement upwardly,
b) admitting the fluid so as to cover the can body (in its up position),
c) admitting the electric current and then cutting it off, and
d) stopping the circulation of the fluid.

In the case of cleaning operations without current, or intermediate rinsing operations, operation c) is omitted.

The nature of the cleaning, coating and rinsing fluids is known to the man skilled in the art in dependence on the shaping method used and the subsequent use envisaged for the can bodies. Examples will provide indications in that respect, without limiting the scope of the invention.

The cleaning or rinsing operations can be completed by the introduction into the cleaning or rinsing chamber of one or more gas flows which increase the turbulence of the bath and thus enhance the effectiveness of the cleaning action (or rinsing action).

In a variant, in which the method consists of a batchwise treatment of cans, the process comprises the following operations:

a) a batch of can bodies is disposed upside down in a basket,
b) said basket is moved into a cleaning station, each can body being in vertical alignment with a cleaning fluid injection nozzle and each can bottom coming into contact with an electrode upon injection of the cleaning fluid by vertical upward displacement of the can,
c) the cleaning fluid is admitted,
d) current is applied if the cleaning operation is of electrolytic nature, and then it is cut off,
e) the cleaning fluid is stopped,
f) the basket is transported into the following rinsing station, of a similar constitution to the foregoing, but which does not have current feed devices or which is provided with current feed devices which are not supplied with current,
g) the rinsing fluid is admitted and then it is stopped,
h) the basket is transported into the following coating station, of a similar constitution to the cleaning station,
i) the electrophoretic suspension is admitted,
j) the direct current is admitted, the nozzles constituting the cathode,
k) the current and the electrophoretic flux are cut off, and
l) the basket is transported into the following rinsing station which is similar to or the same station as the rinsing station (f).

Those operations are generally completed by operations for drying and baking the coatings produced.

In the case of the process which operates on batches of cans, the apparatus according to the invention is composed of a plurality of elements, comprising at least a cleaning station, a rinsing station, a coating station, and a movable basket which is transportable from one station to the other and which contains the can bodies to be cleaned, rinsed or coated.

The basket which is formed of insulating material of the plastic-coated metal wire type comprises an apertured bottom and housings which are defined by vertical frame portions, the housings being disposed in a regular configuration and covering the entire surface of the bottom of the basket. The housings are generally of a right prismatic shape with a polygonal base, preferably regular such as square or hexagonal, forming a system covering the entire bottom of the basket, and lateral edges provided by the frame portions; their transverse dimensions are such that the circle corresponding to the largest of the diameters of the cans to be treated can be inscribed therein. The side walls of the housings are defined by vertical frame portions which are covered with plastics material.

The basket is made of a material which is inert in relation to the cleaning, rinsing or coating fluids used. In addition it is preferable to place between the vertical frame portions, at the lower level (or a plurality of levels), one (or more) rings of insulating material, the external rim of which engages into a peripheral groove in the coated frame portion and whose internal diameter is slightly larger than that of the can body to be treated. As will be seen hereinafter in the examples, the ring or rings serve or serves as a guide in the rising movement of the can, while adapting to the different sizes of the cans to be treated.

The cleaning station is essentially formed by a parallelepipedic tank which comprises a bottom and side walls and which is open in its upper part, and a cover which is fitted thereto. Disposed in the bottom of the tank are on the one hand injection nozzles passing therethrough, which are positioned substantially at the centre of each of the corresponding housings of the basket, and on the other hand electrodes.

The array of the nozzles is connected by a suitable conduit system to a fluid reservoir (cleaning, rinsing or coating fluid), either under the effect of a head or preferably by way of a pump; the overflow which is defined by a discharge pipe returns to the fluid reservoir after possible filtration or ultra-filtration.

The tank also comprises a lower emptying opening provided with a valve or a tap. The tank is of a material which is inert in relation to the fluids used and is preferably formed by a metal container encased with plastics material. The nozzles are of electrically conductive material such as graphite or stainless steel.

Also disposed on the bottom of the tank are vertical electrodes which are arranged regularly on the outside of the housings of the basket. The electrodes may be provided with insulating sleeves which permit their active surface area possibly to be reduced. They serve as auxiliary electrodes for the purposes of improved homogeneity in terms of the thickness of the electrophoretic coating and improved regularity in regard to external cleaning of the cans. They also serve for guiding the basket when it is set in place. In another variant, the electrodes may no longer be fixed with respect to the tank but with respect to the basket itself; they will then be common to the cleaning and coating operations.

They are electrically insulated from the tank (or the basket) and are connected to one of the poles of a current source by way of a switch.

They are for example of graphite in the case of the cleaning station and metal (stainless steel) in the case of the coating station.

In the vicinity of the centre of each of the housings, the cover comprises an electric current feed which is formed by a conducting portion, for example of metal (preferably of stainless steel) for the coating operation, or of aluminum for the cleaning operation. Their lower ends may be enlarged in a mushroom-like configuration (like for example a dome-head screw, which is positioned with its head downwards), providing for contact with the bottom of the can in the course of treatment.

All those current feeds are connected to one of the poles of a current source, for example providing alternating current in the case of the cleaning operation or direct current (anode) in the case of electrophoretic coating, with the necessary cut-out or starting devices (switches). In the latter case the direct current is preferably a pulsewise current.

The coating station is identical to the cleaning station described above, except as regards the nature of the fluid used.

BRIEF DESCRIPTION OF THE DRAWINGS

The invention will be better appreciated by reference to the following detailed description illustrated by FIGS. 1 to 4 which constitute an example of a device for discontinuous treatment.

DESCRIPTION OF THE PREFERRED EMBODIMENTS

Figure 1:
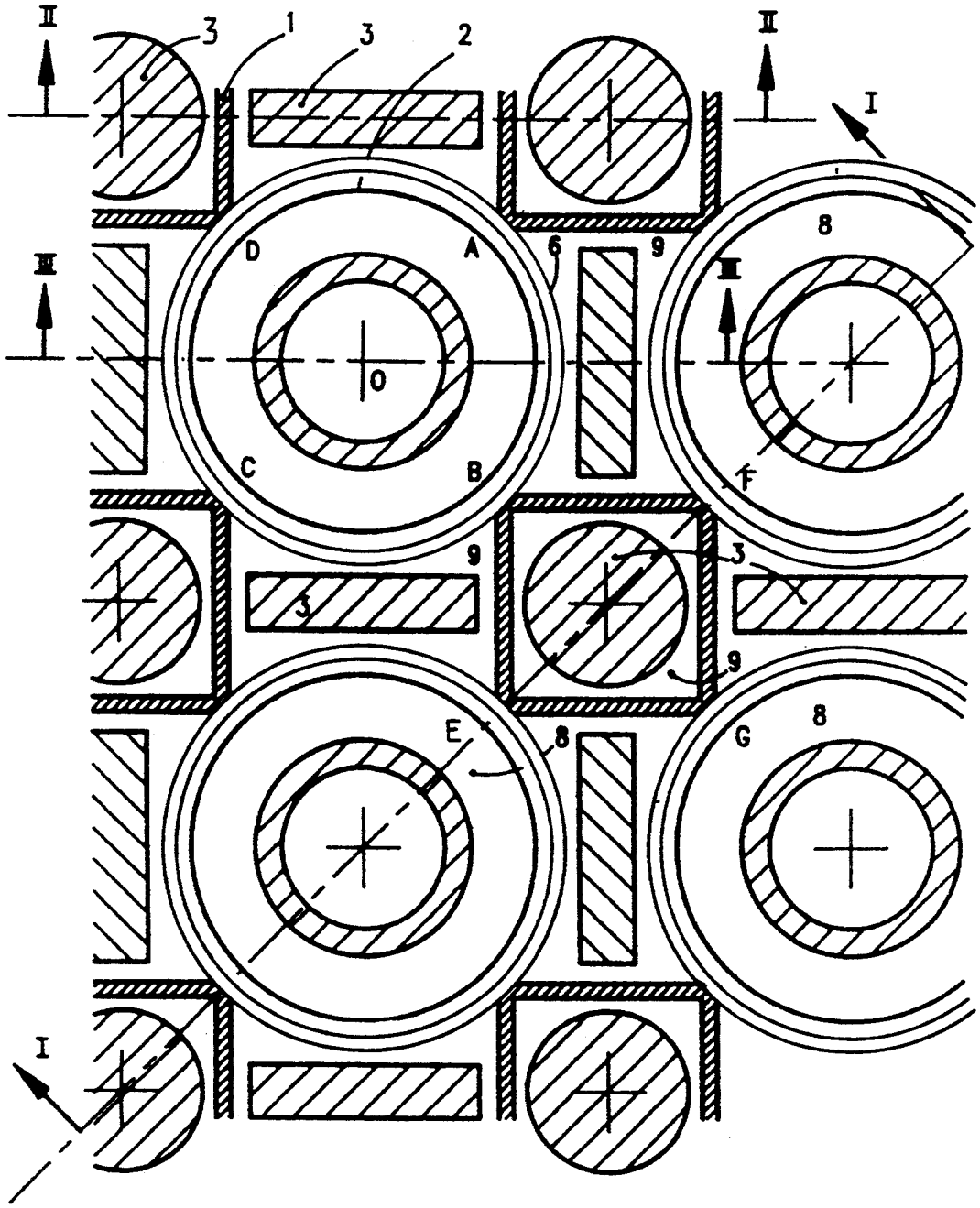
FIG. 1 is a view in horizontal section, showing a part of a basket in the cleaning, rinsing or coating position, taken along line IV—IV of FIG. 2A.
Figure 2A:
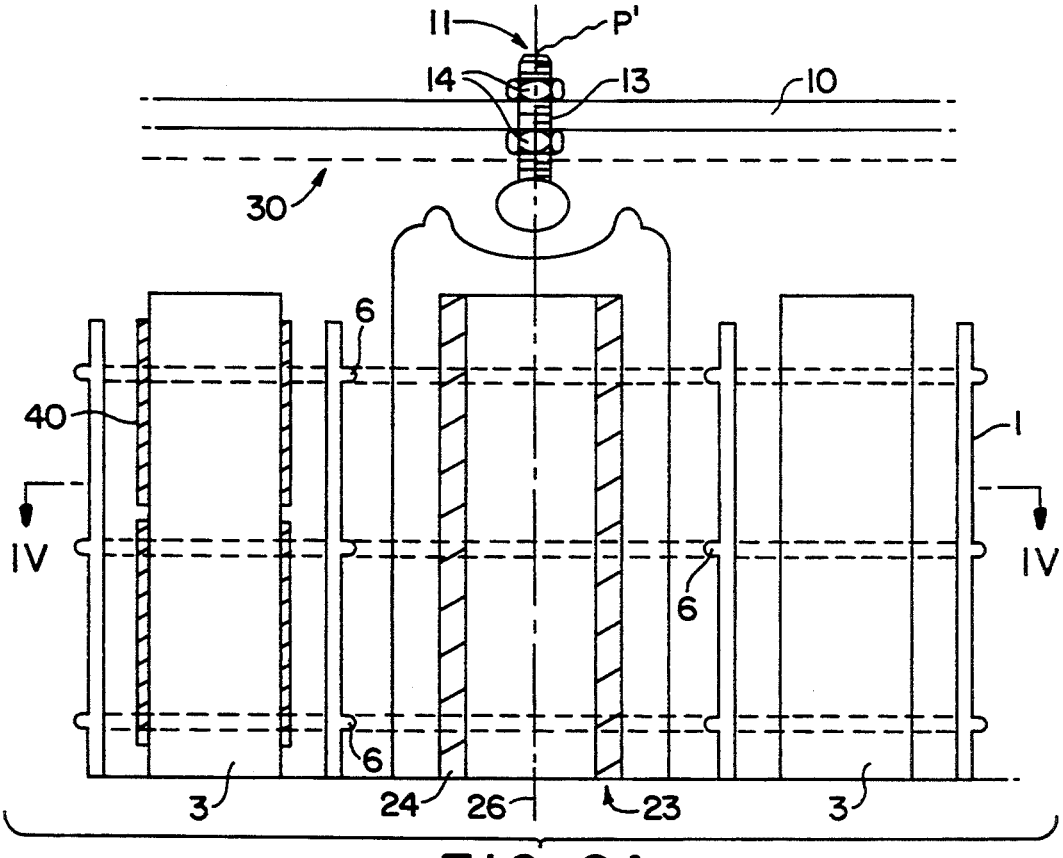
FIG. 2A shows a view of a basket in vertical section taken along line I—I in FIG. 1.
Figure 2B:
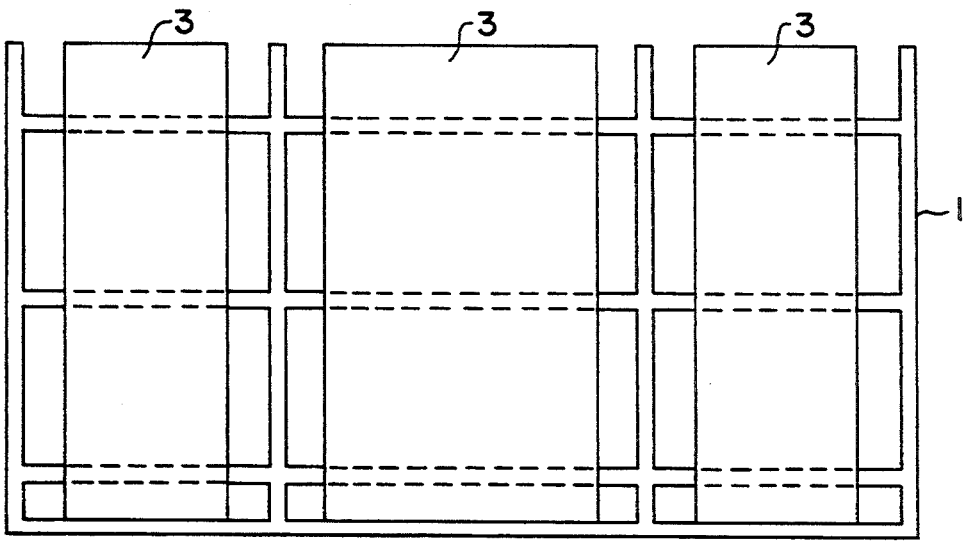
FIG. 2B shows a view of a basket in vertical section taken along line II—II in FIG. 1.
Figure 3:
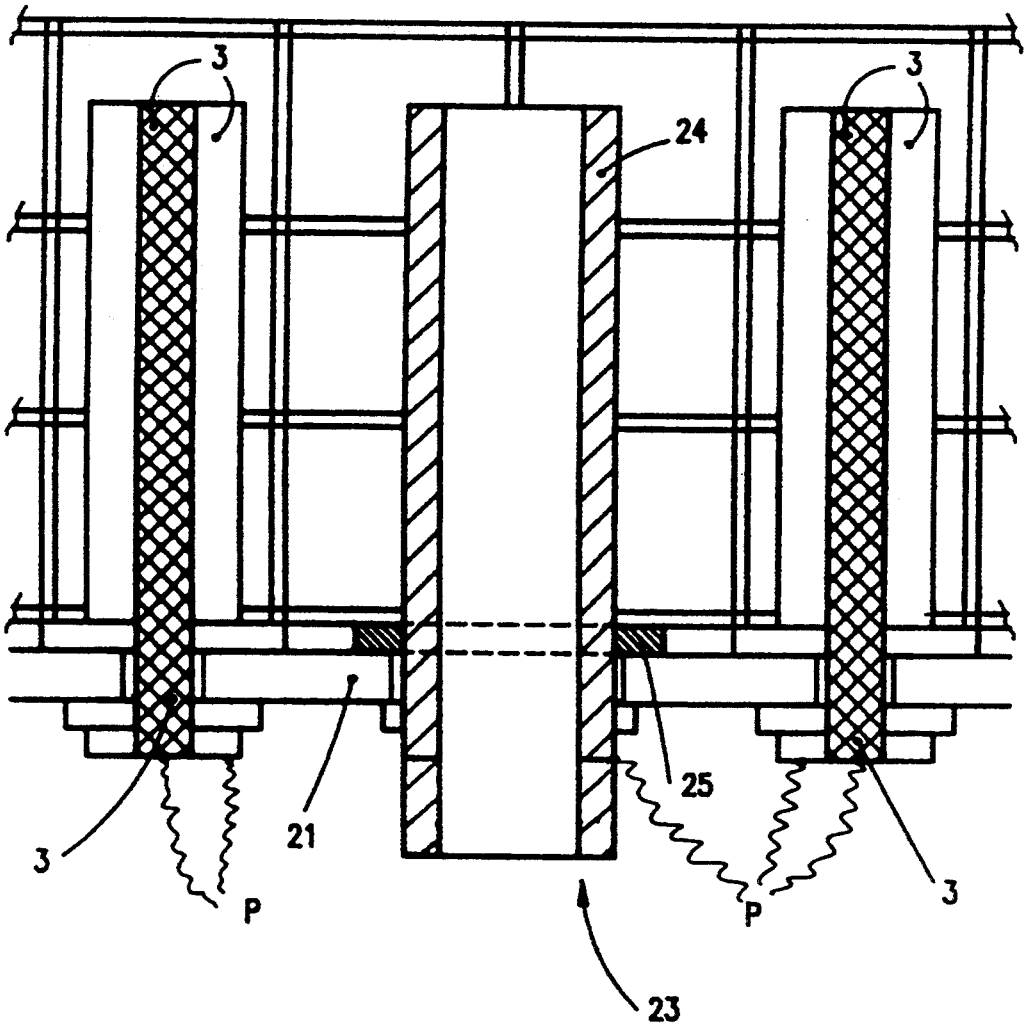
FIG. 3 is a view of a basket in section in a vertical plane along the line III—III in FIG. 1.

As shown in the drawings, a basket is formed by a metal frame 1 encased with plastics material forming a base and apertured side walls. It comprises 20×20 housings, with a square base as indicated at ABCD. Disposed at each of the corners of the squares is a vertical encased frame portion. Disposed in each of the housings is a metal can 2 which is disposed upside down and which rests on the frame portions 1 of the basket. The centre of the housing O is disposed substantially in vertical alignment with the axis 26 of the injection nozzle 24.

The electrodes 3, which can be masked by an insulating sleeve 40, are disposed at the centre of the quadrilateral BEFG. Placed between the can body 2 and the frame portions 1 is a ring 6 of plastics material, which is fixed on the vertical frame portions by clipping or welding and whose internal diameter is slightly greater than the external diameter of the can body 2.

The cleaning section is formed by a parallelepipedic tank comprising a bottom 21, and side walls, of plastics material, which is open in its upper part and which is capable of containing the above-described basket and is inert in relation to the fluids used.

Extending through the bottom 21 are injection nozzles 23 which are formed by a tube 24 and a base 25 and which are disposed substantially on the axes O of the baskets; the tubes 24 penetrate into the can body 2 by way of the opening 8.

The electrodes 3 also extend through the bottom 21 in a sealing and electrically insulated fashion. The electrodes 3 and the nozzles 23 are connected to a pole P of the current source (not shown). the electrodes pass into the housings in the basket by way of the openings 9 thereof (see FIG. 1). The electrodes 3 also serve as guide elements for the basket when being set in position in the treatment tank.

Each of the cans being surrounded by 8 electrodes, it is possible as desired to modulate the distribution of the current lines around each of the cans. In the case of the treatment involving coating by electrophoresis, it is possible to mask a part of the external surface of the electrodes 3 by means of insulating sleeves (not shown) so as to optimise the useful conducting surface area thereof.

As already indicated, the electrodes 3 can be fixed with respect to the cover 10 or the basket (1) instead of being fixed with respect to the bottom of the tank 21.

The tank also comprises an overflow and an emptying pipe.

The coating tank is of a similar constitution to the cleaning tank. The rinsing tank is also similar but it does not have any current feeds 11 or electrodes 3.

Placed on the tank is a cover 10 of insulating material which comprises, substantially on the axis O of the housing, a current feed 11 of stainless steel (coating operation) or graphite (cleaning operation), which has a cylindrical body 13 and which is held in place by a system comprising a nut and a lock nut, as indicated at 14, and connected to the other pole P' of the current source (not shown).

In this embodiment, the can bodies being treated are of 3104 and are of the following dimensions:

external $\phi=65$ mm
total height: 125 mm
thickness of the bottom: 0.3 mm
wall thickness: 0.17 mm
useful height (hB): 120 mm.

The height of the nozzles $h_A$ is 105 mm and their diameter is 30 mm. The height under the current feed $h_C$ is 130 mm.

Figures 4A, 4B:
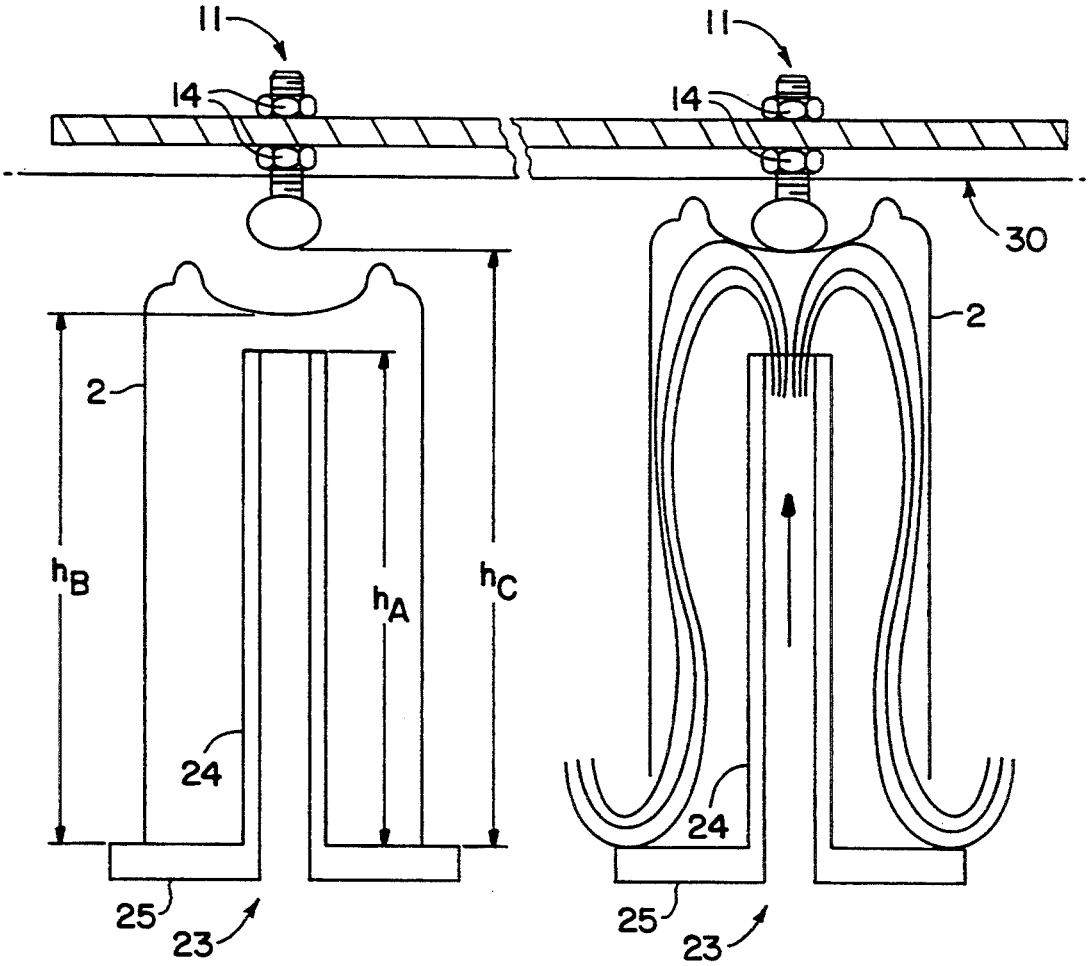
FIG. 4A shows the position of a can body prior to or after circulation of electrolyte, cleaning or rinsing fluid.
FIG. 4B shows the position of a can body during circulation of electrolyte, cleaning or rinsing fluid.

The 400 can bodies are placed head downwards in the basket comprising 20×20 housings, which is moved to the cleaning station (FIG. 4A), the nozzles 24 and the current feeds 11 being connected to the terminals of an AC generator at a voltage of 15 volts.

The electrolyte formed by a solution of phosphoric acid whose electrical conductivity at 70°–75° C. is 70 mS/mis then admitted into the tank, by operating the circulation pump, providing a flow of 2 $m^3$/h per nozzle. Under the effect of circulation of the electrolyte, the can bodies are lifted (see FIG. 4B) and their bottom is pressed against the heads of the current feeds (12) and they are purged of the air that they contain; the tank is filled with electrolyte to the level 30 of the overflow, FIG. 4; the electrolyte then completely immerses the can bodies in the upward position. The electric current is then established for a period of from 2 to 5 s.

After the pump is stopped, the can bodies drop down into the downward position (FIG. 4A) and the tank is emptied by way of the drain provided for that purpose.

The basket is withdrawn and placed in the rinsing station where the can bodies are rinsed with water, obviously without electric current.

The basket is then placed in the coating tank and the nozzles 23, the current feeds 11 and possibly the electrodes 3 being connected to the terminals of a direct current source at a voltage of from 100 to 380 volts, typically 200 volts. In that situation the electrophoresis bath is admitted, comprising anaphoretic varnish on an epoxy base (in a proportion of 10 g/liter, in water), whose pH-value is 7.7, conductivity is 1.76 mS/m and with the temperature being maintained at 30° C., by way of nozzles 23, and a cycle similar to the cleaning cycle is initiated. Here however the anaphoretic treatment time is from 2 to 15 seconds, which makes it possible to deposit a layer of from 1 to 10 μm of resin, with a pulse-wise direct current (typically 50 ms with current+20 ms without current).

After the coating cycle, the rinsing operation is carried out under the same conditions as above.

In addition the above-described apparatuses are very simple from the mechanical point of view.

Finally the process of the invention does not require any drying operation between the cleaning and coating operations, which provides a significant simplification, giving gains in terms of energy and capital investment.

What is claimed is:

1. Apparatus for cleaning, rinsing and coating a metal can body, comprising:

a) a tank for containing a liquid;

b) a nozzle formed of an electrically conductive material, apertured with an axial duct, and maintained in a substantially vertical direction with said duct being open upwardly, into said tank;

c) means for supporting a can body in an inverted condition within said tank and disposing said can body in inverted condition over said nozzle; and d) electrical contact means disposed in an upper portion of said tank directly above said nozzle and axially aligned with said duct;

said means for supporting comprising means for freely displacing the can body supported thereon in vertical upward direction between said nozzle and said electrical contact means, under the force of liquid flowing through said nozzle.

2. Apparatus according to claim 1, wherein the nozzle and the electrical contact means are electrically connected to opposite poles of an electric current source.

3. Apparatus according to one of claims 1 and 2 additionally comprising auxiliary electrodes connected to a current source pole.

4. Apparatus according to claim 3, wherein a part of an external surface of the auxiliary electrodes is masked by insulating sleeves.

5. An apparatus for cleaning, electrophoretically coating and rinsing metal can bodies comprising a cleaning station, a rinsing station, a electrophoretic coating station, and a movable basket which is transportable from one station to another for containing the can bodies to be treated at said stations, wherein:

a) said movable basket comprises a bottom provided with openings and housings which are contiguous, each of which is adapted to contain a can body disposed in inverted condition, said openings and housings being regularly distributed over the bottom;

b) said cleaning and electrophoretic coating stations comprise a tank having a bottom having extending therethrough nozzles for the injection of fluids and electrodes, and a cover including electrical contact means extending therethrough, said electrical contact means being regularly distributed over the cover, aligned with said housings; and c) said movable basket is aligned with said tank in said cleaning station and said electrophoretic coating station such that said nozzles pass through said openings.

6. Apparatus according to claim 5, wherein the movable basket is formed by a metal frame encased with plastic material.

7. Apparatus according to claim 6 additionally comprising at least one ring of plastic material, having an internal diameter slightly larger than an external diameter of the can body to be contained by said basket, disposed between vertical portions of the basket.

8. Apparatus according to claim 5, wherein the nozzles are formed by a tubular cylindrical portion and a conducting base.

9. Apparatus according to claim 5, wherein the electrical contact means is formed of stainless steel or aluminum

10. Apparatus according to claim 9, wherein the electrical contact means is enlarged in the shape of a mushroom.

11. Apparatus according to claim 5, wherein the electrical contact means is connected to a pole of a current source.

12. Apparatus according to claim 11, wherein the nozzles and the electrodes are connected to an opposite pole of the current source.

13. Apparatus according to claim 5, wherein the rinsing station is formed by a tank having a bottom having nozzles extending therethrough for the injection of fluids.

* * * * *